US011235951B2

(12) United States Patent
Convard et al.

(10) Patent No.: US 11,235,951 B2
(45) Date of Patent: Feb. 1, 2022

(54) OPENABLE ELEVATOR CAR WALL PANELS

(71) Applicant: Otis Elevator Company, Farmington, CT (US)

(72) Inventors: Emmanuel Convard, La Bussiere (FR); Christele Gressien, La Bussiere (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 306 days.

(21) Appl. No.: 16/400,430

(22) Filed: May 1, 2019

(65) Prior Publication Data

US 2019/0337764 A1 Nov. 7, 2019

(30) Foreign Application Priority Data

May 3, 2018 (EP) ..... 18305553

(51) Int. Cl.
*B66B 11/02* (2006.01)

(52) U.S. Cl.
CPC ..... *B66B 11/0253* (2013.01); *B66B 11/0206* (2013.01); *B66B 11/0246* (2013.01)

(58) Field of Classification Search
CPC ..... B66B 11/0253; B66B 11/0206; B66B 11/0246
See application file for complete search history.

(56) References Cited

U.S. PATENT DOCUMENTS 4,635,756 A * 1/1987 Sherwood ..... B66B 11/0253 187/401
4,711,322 A * 12/1987 Orndorff ..... E04B 9/18 187/401
6,209,931 B1 * 4/2001 Von Stoutenborough ..... E05C 9/041 292/160
6,484,850 B1 * 11/2002 Kobayashi ..... B66B 11/002 187/414
6,902,040 B2 * 6/2005 Fujita ..... B66B 11/0206 187/314
6,971,686 B2 * 12/2005 Becken ..... E05B 63/20 292/142

(Continued)

FOREIGN PATENT DOCUMENTS

CN 101068738 A 11/2007
CN 101588980 B 3/2012

(Continued)

OTHER PUBLICATIONS

European Search Report for European Application No. 18305553.2, International Filing Date May 3, 2018, dated Oct. 16, 2018, 10 pages.

(Continued)

*Primary Examiner* — Michael A Riegelman
(74) *Attorney, Agent, or Firm* — Cantor Colburn LLP

(57) ABSTRACT

Elevators and elevator car wall panel systems are provided herein. The systems include an elevator car frame, at least two wall panels pivotally connected to the frame, a connecting element operably connecting the at least two wall panels, and an actuation element operably connected to the connecting element, wherein the actuation element is operable to transition the at least two wall panels from a closed state to an open state.

17 Claims, 5 Drawing Sheets

(56) References Cited

U.S. PATENT DOCUMENTS

| | | | | |
|---|---|---|---|---|
| 7,404,306 | B2 * | 7/2008 | Walls | E05C 9/20 292/139 |
| 7,556,126 | B2 * | 7/2009 | Wang | B66B 5/027 187/263 |
| 7,878,034 | B2 * | 2/2011 | Alber | E05C 7/06 70/107 |
| 9,796,562 | B2 | 10/2017 | Yao | |
| 2005/0224299 | A1 * | 10/2005 | Soemardjan | B66B 11/0246 187/406 |
| 2008/0217113 | A1 * | 9/2008 | Bonatre | B66B 5/0081 187/401 |
| 2010/0038183 | A1 * | 2/2010 | Henseler | B66B 11/0246 187/276 |
| 2010/0176944 | A1 * | 7/2010 | Shell | B66B 9/0869 340/541 |
| 2012/0104917 | A1 * | 5/2012 | Fan | H05K 7/1488 312/326 |
| 2012/0255815 | A1 * | 10/2012 | Koskelainen | B66B 11/0226 187/401 |
| 2015/0167355 | A1 * | 6/2015 | Coltel | E05B 65/10 292/138 |
| 2015/0246792 | A1 * | 9/2015 | Baltis | B66B 5/0087 187/276 |
| 2017/0297870 | A1 * | 10/2017 | Fauconnet | B66B 11/0226 |
| 2018/0051468 | A1 * | 2/2018 | Beauchaud | E04F 11/18 |
| 2018/0111797 | A1 * | 4/2018 | Fauconnet | B66B 11/0206 |
| 2018/0222723 | A1 * | 8/2018 | Gressien | B66B 11/0253 |
| 2018/0282127 | A1 * | 10/2018 | Fauconnet | B66B 11/0246 |
| 2019/0337764 | A1 * | 11/2019 | Convard | B66B 11/0226 |

FOREIGN PATENT DOCUMENTS

| | | | |
|---|---|---|---|
| CN | 107298365 | A | 10/2017 |
| EP | 3231758 | A1 | 10/2017 |
| JP | H06271220 | A | 9/1994 |
| JP | H08282928 | A | 10/1996 |
| JP | 2000247563 | A | 9/2000 |
| JP | 2006290565 | A | 10/2006 |
| JP | 2006306527 | A | 11/2006 |
| JP | 2008007276 | A | 1/2008 |
| JP | 2010052859 | A | 3/2010 |
| JP | 2013018574 | A | 1/2013 |
| JP | 2013220865 | A | 10/2013 |
| JP | 2014189386 | A | 10/2014 |
| WO | 2004046010 | A1 | 6/2004 |
| WO | 2009028089 | A1 | 3/2009 |
| WO | 2012053074 | A1 | 4/2012 |
| WO | 2017005327 | A1 | 1/2017 |

OTHER PUBLICATIONS

Shanghai Shenghong Electronic Accessory Co., Ltd.—cabinet lock; Retrieved from Internet; URL: https://shenghonglock.en.alibaba.com/; 2018; 18 pgs.

* cited by examiner

OPENABLE ELEVATOR CAR WALL PANELS

CROSS REFERENCE TO RELATED APPLICATIONS

This application claims the benefit of European Application No. 18305553.2, filed May 3, 2018, which is incorporated herein by reference in its entirety.

BACKGROUND

The subject matter disclosed herein generally relates to elevator car wall panels and, more particularly, elevator car panel systems that allow for ease of opening such panels.

Elevator systems are used to transport passengers within buildings between floors of the building. Elevators include various components located within an elevator shaft (either affixed to the shaft or on an exterior of an elevator car). From time to time, maintenance is performed upon such components, such as inspection, repair, replacement, etc., as appreciated by those of skill in the art.

Entering an elevator shaft has risks and thus reducing the amount of exposure of mechanics and other authorized personnel to the elevator shaft is advantageous. Further, there is a trend to reduce the volumetric footprint of elevator systems within buildings, and thus reducing the required space for various components has advantages. However, to accommodate such improvements, changes in the elevator car may be required. Accordingly, it may be beneficial to have improved elevator car systems that provide for ease of access to components for maintenance while ensuring the safety of mechanics or other personnel.

SUMMARY

According to some embodiments, elevator car wall panel systems are provided. The systems include an elevator car frame, at least two wall panels pivotally connected to the frame, a connecting element operably connecting the at least two wall panels, and an actuation element operably connected to the connecting element, wherein the actuation element is operable to transition the at least two wall panels from a closed state to an open state.

In addition to one or more of the features described herein, or as an alternative, further embodiments of the elevator car wall panel systems may include a locking element arranged to lock the at least two wall panels in the closed state.

In addition to one or more of the features described herein, or as an alternative, further embodiments of the elevator car wall panel systems may include that the connecting element is a rigid rod.

In addition to one or more of the features described herein, or as an alternative, further embodiments of the elevator car wall panel systems may include that each wall panel is pivotally connected to the connecting element by a respective connector.

In addition to one or more of the features described herein, or as an alternative, further embodiments of the elevator car wall panel systems may include that each connector comprises a bracket and a connector extension.

In addition to one or more of the features described herein, or as an alternative, further embodiments of the elevator car wall panel systems may include that each connector extension is a part of the connecting element.

In addition to one or more of the features described herein, or as an alternative, further embodiments of the elevator car wall panel systems may include that the actuation element comprises at least one sliding pivot and at least one rotating pivot.

According to some embodiments, elevator cars are provided that include the elevator car wall panel systems of any of the above described embodiments.

In addition to one or more of the features described herein, or as an alternative, further embodiments of the elevator cars may include that the elevator car includes a passenger space, wherein the at least two wall panels are aesthetic panels of the passenger space.

In addition to one or more of the features described herein, or as an alternative, further embodiments of the elevator cars may include that the connecting element is located at least one of a ceiling and a floor of the elevator car.

According to some embodiments, elevator systems are provided that include the elevator cars as described in the above embodiments, wherein the elevator car is positioned within an elevator shaft of the elevator system.

In addition to one or more of the features described herein, or as an alternative, further embodiments of the elevator systems may include that when the at least two wall panels are opened, at least a portion of the wall panels extends into the elevator shaft.

In addition to one or more of the features described herein, or as an alternative, further embodiments of the elevator systems may include at least one elevator component located within the elevator shaft, wherein when the at least two wall panels are opened, the at least one elevator component is accessible from the passenger space.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
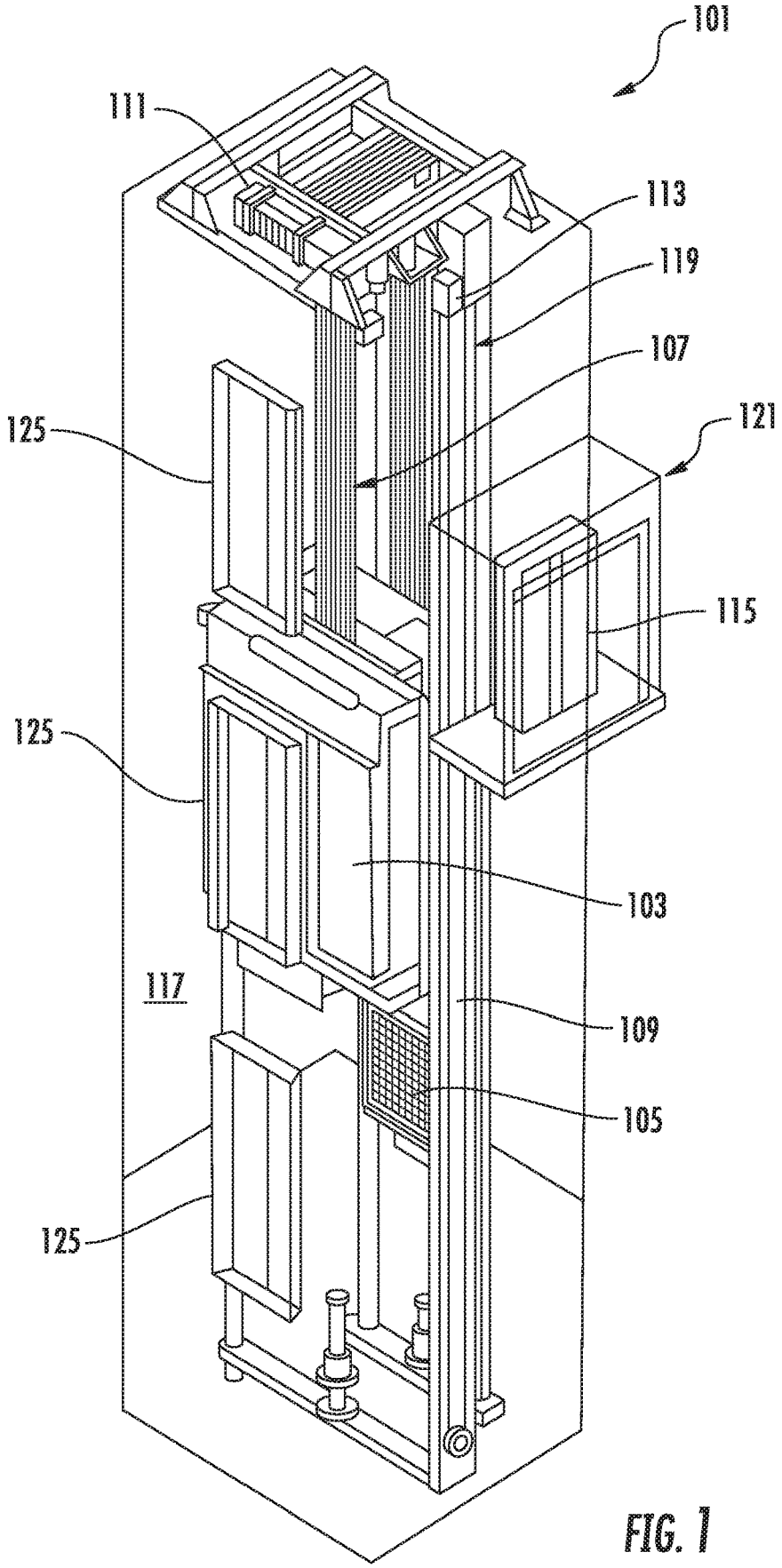
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2A:
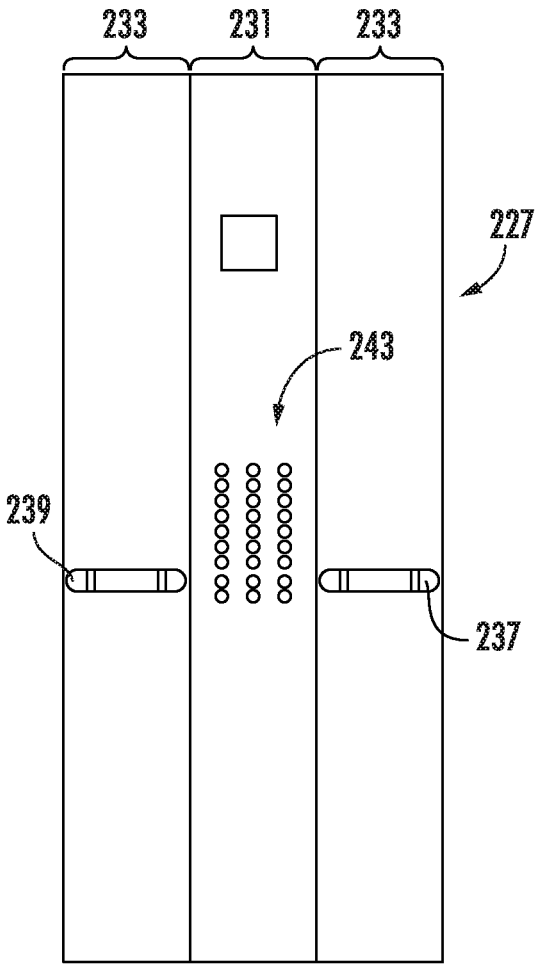
FIG. 2A is an elevation schematic illustration of an elevator car wall panel that can employ embodiments disclosed herein.
Figure 2B:
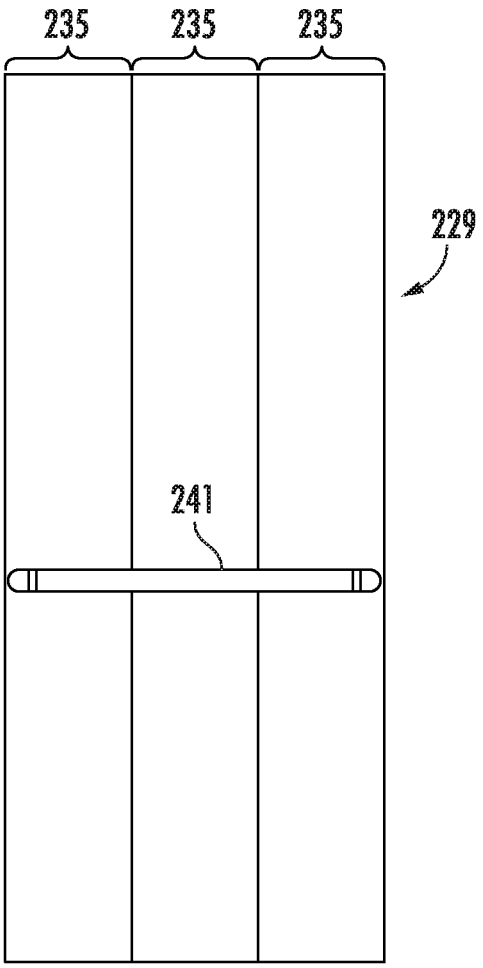
FIG. 2B is an elevation schematic illustration of another elevator car wall panel that can employ embodiments disclosed herein.

Turning to FIGS. 2A and 2B, schematic illustrations of elevator car wall panels 227, 229 that can employ embodiments described herein are shown. FIG. 2A shows a front elevation schematic view of a first elevator car wall panel 227. FIG. 2B shows a front elevation schematic view of a second elevator car wall panel 229. The first elevator car wall panel 227, as shown, includes subpanels 231, 233, wherein a first subpanel 231 includes a control section 243 of the elevator car and second subpanels 233 form aesthetic portions of the elevator car wall panel 227. The first subpanel 231 and the second subpanels 233 are configured to form a wall of an elevator car. The subpanels 231, 233, in some configurations, are parts of a solid or continuous elevator car wall panel, and thus are fixedly connected or are subparts of a continuous wall. The second elevator car wall panel 229 is formed with a number of subpanels 235, which may each be aesthetic panels (i.e., not including operational or functional aspects).

As shown, the second subpanels 233 of the first elevator car wall panel 227 include associated handrails 237, 239. The second elevator car wall panel 229 includes a respective handrail 241 mounted thereto. The handrails 237, 239, 241 are mounted to the respective subpanels 233, 235 of the elevator car wall panels 227, 229 and provide users or passengers of the elevator to have a handrail to provide support or other function. In some embodiments, ends of the handrails 237, 239, 241 may be fixedly attached to, mounted to, and supported by the respective subpanels 233, 235. As noted above, the first subpanel 231 of the first elevator car wall panel 227 includes an operation or control section 243. The control section 243, as shown, includes a number of buttons that are used to enable a passenger to select a destination floor, and may also include emergency buttons, or other buttons as known in the art. The first subpanel 231 may further include other electronic elements, such as speakers, displays, etc., as will be appreciated by those of skill in the art.

The elevator car wall panels can be fixedly and semi-permanently installed to an elevator car structural panel or frame. For example, screws, bolts, or other fasteners can be used to fasten the wall panels to the elevator car structural panel. However, such configurations may not allow easy changing and/or replacement of such elevator car wall panels and/or access to components located behind the wall panels. Accordingly, embodiments provided herein are directed to elevator car wall panels and associated systems that enable easy opening and operation to grant access to elements/components located behind the wall panels, thus avoiding a need for a mechanic to enter an elevator shaft to access such elements/components.

Figure 3A:
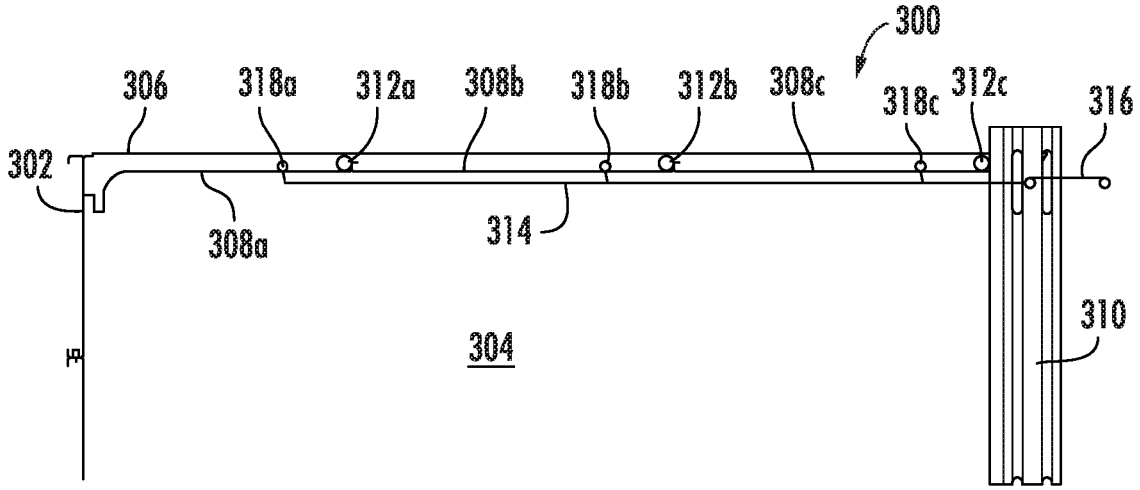
FIG. 3A is a schematic illustration of an elevator car panel system in accordance with an embodiment of the present disclosure, shown in a first state.
Figure 3B:
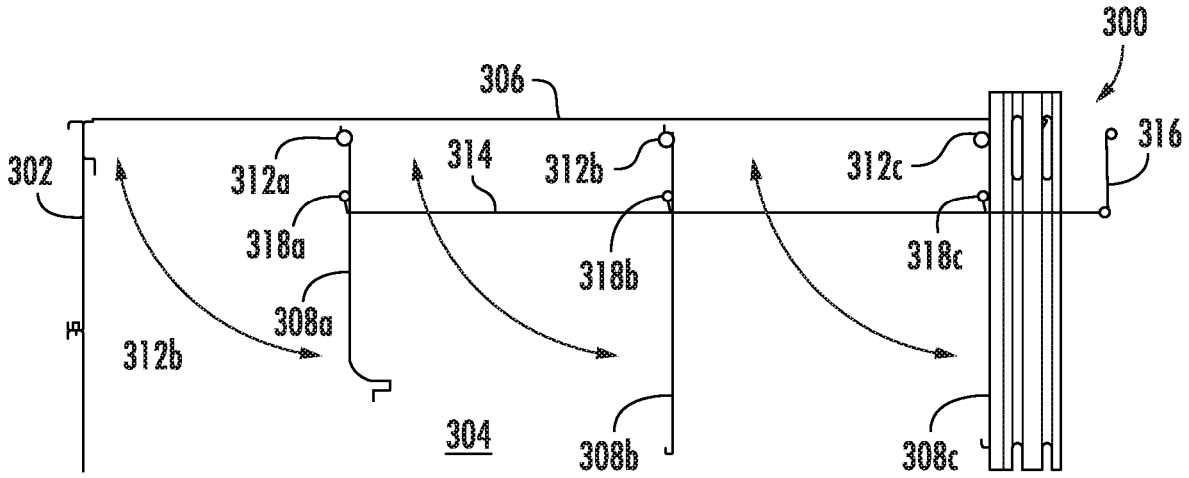
FIG. 3B is a schematic illustration of the elevator car panel system of FIG. 3A, shown in a second state.

For example, turning now to FIGS. 3A-3B, schematic illustrations of an elevator car panel system 300 of an elevator car 302 in accordance with an embodiment of the present disclosure are shown. FIG. 3A illustrates the elevator car panel system 300 in a first or closed state and FIG. 3B illustrates the elevator car panel system 300 in a second or open state. The views of FIGS. 3A-3B are top-down plan views of the elevator car 302 which defines a passenger space 304. The elevator car 302 includes a frame 306 and a number of wall panels 308*a*, 308*b*, 308*c* movably attached to the frame 306. The wall panels 308*a*, 308*b*, 308*c* are aesthetic panels that surround and define the passenger space 304. An elevator car door (not shown) provides access to the passenger space 304 of the elevator car 302. In FIGS. 3A-3B, the elevator car door is represented by a car door sill 310, along which the elevator car door may translate (open/close).

Each wall panel 308*a*, 308*b*, 308*c* is pivotally mounted to the frame 306 at a respective pivot 312*a*, 312*b*, 312*c*. Further, each wall panel 308*a*, 308*b*, 308*c* is operably connected to a connecting element 314, such as a support rod or other rigid body. The connecting element 314 is operable by an actuation element 316 that is operable to actuate, move, translate, etc. the connecting element 314 to, in turn, open (or close) the wall panels 308*a*, 308*b*, 308*c*, as described herein. The connecting element 314 may be located at a top or bottom of the frame 306 (e.g., proximate a floor or ceiling of the elevator car 302). Although shown with the connecting element 314 arranged relatively on the interior of the car frame 306, in other embodiments, the connecting element may be located above the car frame or even located on the exterior of the car frame, i.e., located on the elevator shaft side of the car frame.

Each wall panel 308*a*, 308*b*, 308*c* is operably connected to the connecting element 314 by a respective connector 318*a*, 318*b*, 318*c*. The connectors 318*a*, 318*b*, 318*c* may be brackets or similar structures that allow for the movement of the connecting element 314 to force or urge the wall panels 308*a*, 308*b*, 308*c* to move about the respective pivots 312*a*, 312*b*, 312*c*, as shown in FIG. 3B.

As shown in FIGS. 3A-3B, the actuation element 316 can be rotated or actuated to apply a force on the connecting element 314. The connecting element 314 will translate or otherwise move, thus applying a force on each of the wall panels 308*a*, 308*b*, 308*c* through the connectors 318*a*, 318*b*, 318*c*. As the connecting element 314 moves from a first position (FIG. 3A) to a second position (FIG. 3B), the wall panels 308*a*, 308*b*, 308*c* will open, as shown in FIG. 3B. With the wall panels 308*a*, 308*b*, 308*c* opened, a mechanic or other authorized person may access components or elements located behind the wall panels 308*a*, 308*b*, 308*c*.

In the first or closed state (FIG. 3A), the elevator car panel system 300 may be locked or secured such that the wall panels 308*a*, 308*b*, 308*c* cannot be opened, thus preventing unauthorized access. To open the wall panels 308*a*, 308*b*, 308*c*, the elevator car panel system 300 may be unlocked and then the actuation element 316 may be operated to open the wall panels 308*a*, 308*b*, 308*c*.

Figure 4A:
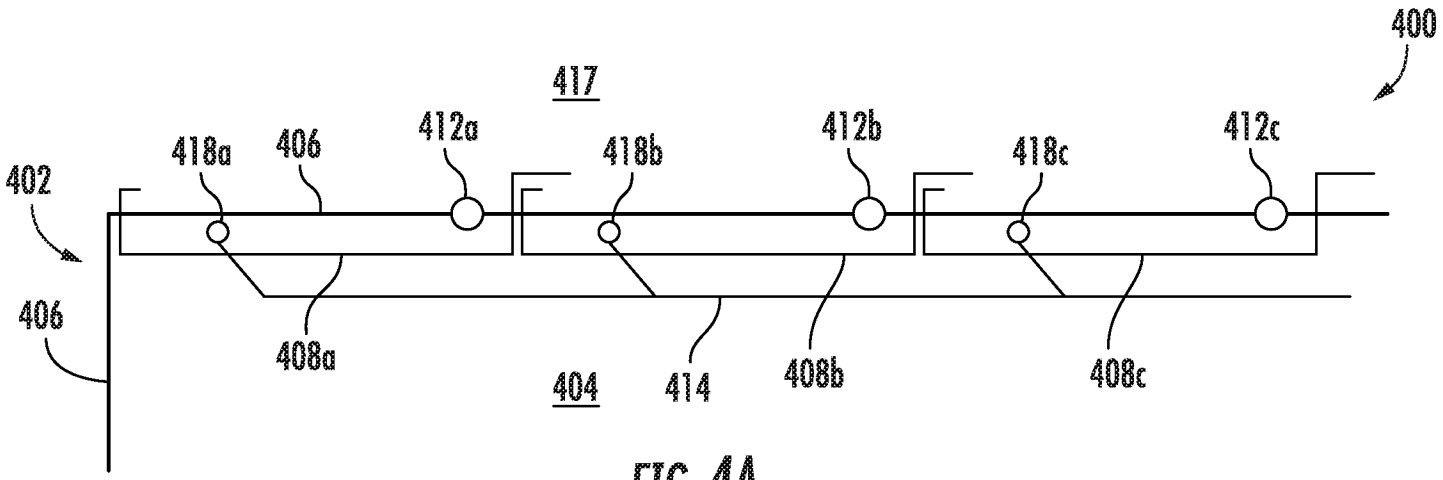
FIG. 4A is a schematic illustration of an elevator car panel system in accordance with an embodiment of the present disclosure, shown in a first state.
Figure 4B:
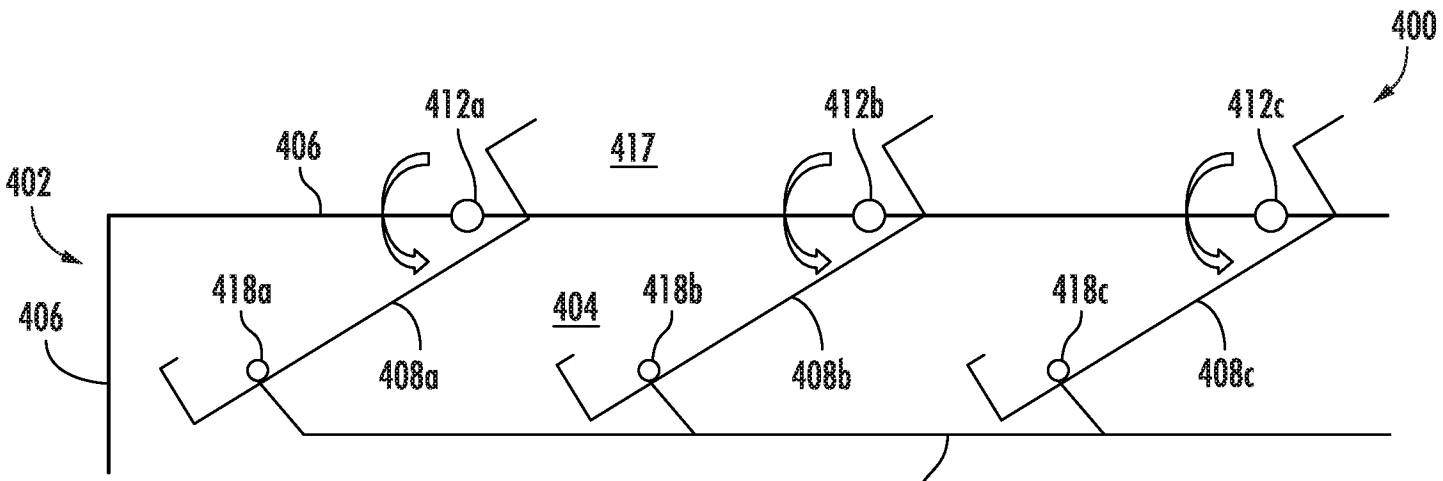
FIG. 4B is a schematic illustration of the elevator car panel system of FIG. 4A, shown in a second state.

Turning now to FIGS. 4A-4B, schematic illustrations of an elevator car panel system 400 of an elevator car 402 in accordance with an embodiment of the present disclosure are shown. FIG. 4A illustrates the elevator car panel system 400 in a first or closed state and FIG. 4B illustrates the elevator car panel system 400 in a second or open state. Similar to FIGS. 3A-3B, the illustrations are top-down plan views of the elevator car 402 which defines a passenger space 404, and an elevator shaft 417 is shown relative to the elevator car 402. The elevator car 402 includes a frame 406 and a number of wall panels 408*a*, 408*b*, 408*c* movably attached to the frame 406. The wall panels 408*a*, 408*b*, 408*c* are aesthetic panels that surround and define the passenger space 404.

Each wall panel 408*a*, 408*b*, 408*c* is pivotally mounted to the frame 406 at a respective pivot 412*a*, 412*b*, 412*c*. Further, each wall panel 408*a*, 408*b*, 408*c* is operably connected to a connecting element 414, such as a support rod or other rigid body. The connecting element 414 is operable by an actuation element, not shown, that is operable to actuate, move, translate, etc. the connecting element 414 to, in turn, open (or close) the wall panels 408*a*, 408*b*, 408*c*, as described herein. The connecting element 414 may be located at a top or bottom of the frame 406 (e.g., proximate a floor or ceiling of the elevator car 402). Although shown with the connecting element 414 arranged relatively on the interior of the car frame 406, in other embodiments, the connecting element may be located above the car frame or even located on the exterior of the car frame, i.e., located on the elevator shaft side of the car frame.

Each wall panel 408*a*, 408*b*, 408*c* is operably connected to the connecting element 414 by a respective connector 418*a*, 418*b*, 418*c*. The connectors 418*a*, 418*b*, 418*c* may be brackets or similar structures that allow for the movement of the connecting element 414 to force or urge the wall panels 408*a*, 408*b*, 408*c* to move about the respective pivots 412*a*, 412*b*, 412*c*, as shown in FIG. 4B. As the connecting element 414 is actuated or operated, the wall panels 408*a*, 408*b*, 408*c* are opened by rotations about the respective pivots 412*a*, 412*b*, 412*c*. The connecting element 414 translates or otherwise moves, thus applying a force on each of the wall panels 408*a*, 408*b*, 408*c* through the connectors 418*a*, 418*b*, 418*c*. As the connecting element 414 moves from a first position (FIG. 4A) to a second position (FIG. 4B), the wall panels 408*a*, 408*b*, 408*c* will open, as shown in FIG. 4B. With the wall panels 408*a*, 408*b*, 408*c* opened, a mechanic or other authorized person may access components or elements located behind the wall panels 408*a*, 408*b*, 408*c*. As shown, in this embodiment, a portion of the wall panels 408*a*, 408*b*, 408*c* may extend into the elevator shaft 417.

In some embodiments, when the wall panels 408*a*, 408*b*, 408*c* are opened, as shown in FIG. 4B, a person may access the elevator shaft 417 and components thereof. That is, in some embodiments, after opening the wall panels 408*a*, 408*b*, 408*c*, a person may gain access to components in the elevator shaft 417 such as guide rails, electrical or electronic components, exterior components of the elevator car 402, etc. Such access is granted from the passenger space 404 of the elevator car 402, and thus a person is not required to enter the elevator shaft 417 to gain access thereto.

Figure 5A:
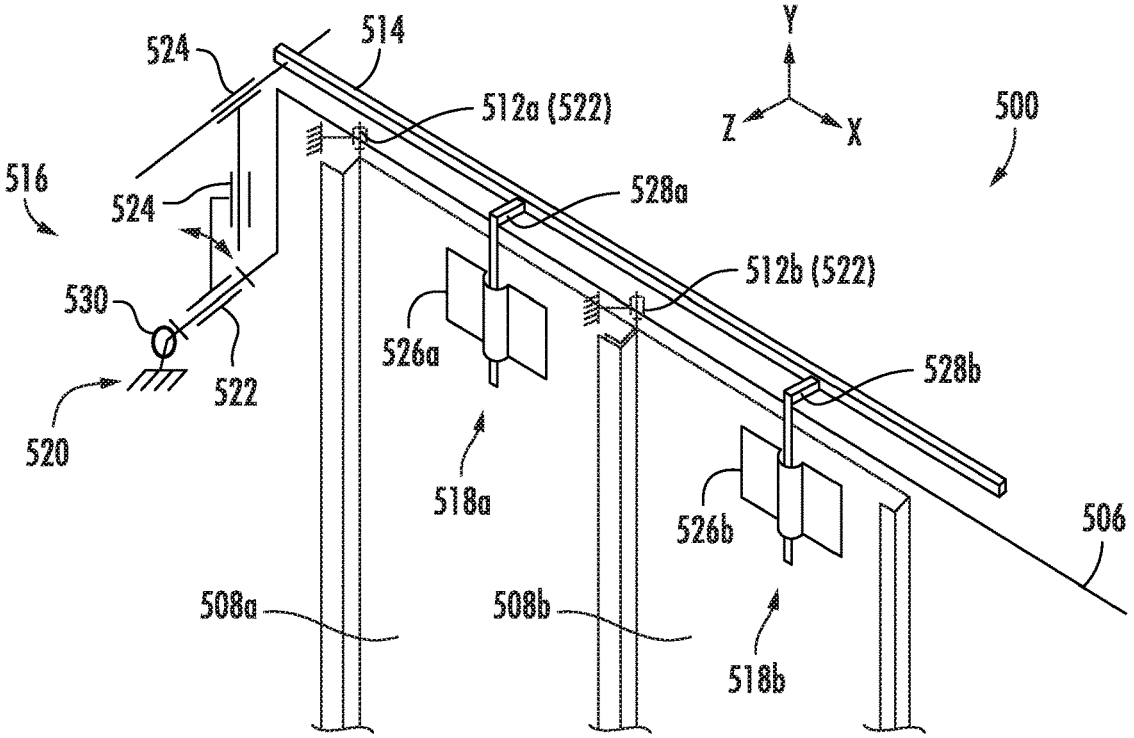
FIG. 5A is a schematic, kinematic illustration of an elevator car panel system in accordance with an embodiment of the present disclosure, shown in a first state.
Figure 5B:
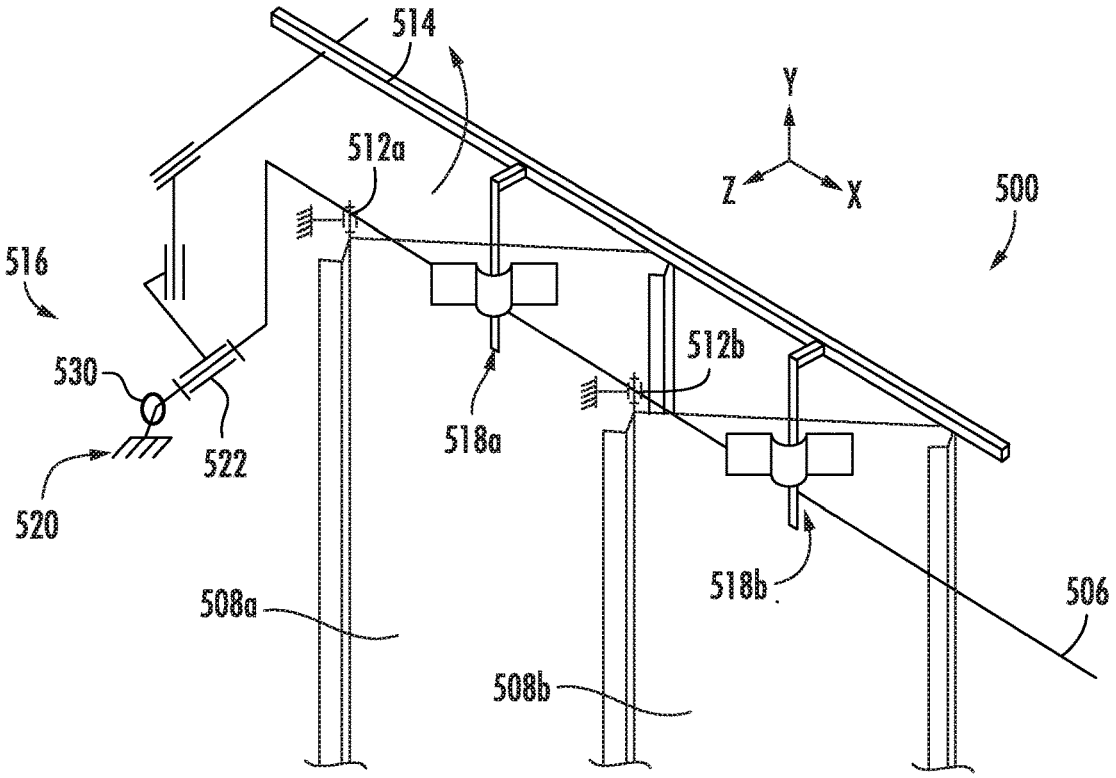
FIG. 5B is a schematic, kinematic illustration of the elevator car panel system of FIG. 5A, shown in a second state.

Turning now to FIGS. 5A-5B, schematic, kinematic illustrations of an elevator car panel system 500 of an elevator car in accordance with an embodiment of the present disclosure are shown. FIG. 5A illustrates the elevator car panel system 500 in a first or closed state and FIG. 5B illustrates the elevator car panel system 500 in a second or open state. FIGS. 5A-5B are schematic views from an exterior position viewing wall panels 508*a*, 508*b* that are movably attached to a frame 506. In FIGS. 5A-5B, element 520 indicates a fixed connection to the frame 506, element 522 indicates a rotating pivot, and element 524 indicates a sliding pivot.

Each wall panel 508*a*, 508*b* is pivotally mounted to the frame 506 at a respective pivot 512*a*, 512*b*, with the pivots 512*a*, 512*b* being rotating pivots 522. Further, each wall panel 508*a*, 508*b* is operably connected to a connecting element 514, such as a support rod or other rigid body. As shown in FIGS. 5A-5B, the wall panels 508*a*, 508*b* are connected to the connecting element 514 by respective connectors 518*a*, 518*b*. As shown, the connectors 518*a*, 518*b* include a bracket 526*a*, 526*b* and a connector extension 528*a*, 528*b*. The brackets 526*a*, 526*b* and the connector extensions 528*a*, 528*b* form a rotatable connection between the connecting element 514 and the respective wall panels 508*a*, 508*b*. In some embodiments, the connector extensions 528*a*, 528*b* are part of the connecting element 514. Part of the wall panels 508*a*, 508*b* is connected to the frame 506 by respective pivots 512*a*, 512*b*, which are rotating pivots 522. The pivots 512*a*, 512*b* are at last partially fixedly connected to the frame 506.

The connecting element 514 is operable by an actuation element 516 that is operable to actuate, move, translate, etc. the connecting element 514 to, in turn, open (or close) the wall panels 508*a*, 508*b*. The connecting element 514 may be located at a top or bottom of the frame 506 (e.g., proximate a floor or ceiling of an elevator car). The actuation element 516 can include one or more rotating pivots 522 and one or more sliding pivots 524, as schematically shown.

As the actuation element 516 is actuated or operated, the pivots 522, 524 move, as schematically shown in the change between FIG. 5A and FIG. 5B, such that the connecting element 514 is moved (e.g., rotation and translation). The wall panels 508*a*, 508*b* may thus be opened by rotation about the respective pivots 512*a*, 512*b*. The connecting element 514 translates or otherwise moves and applies a force on each of the wall panels 508*a*, 508*b* through the connectors 518*a*, 518*b*. As the connecting element 514 moves from a first position (FIG. 5A) to a second position (FIG. 5B), the wall panels 508*a*, 508*b* will open, as shown in FIG. 5B. With the wall panels 508*a*, 508*b* opened, a mechanic or other authorized person may access components or elements located behind the wall panels 508*a*, 508*b*.

Accordingly, in accordance with some embodiments of the present disclosure, operation of an actuation element enables easy opening and closing of all wall panels of an elevator car. The systems described herein can include a rotary actuator, a rod which ensures all panels are integrally moved, and pivots on each panel, as shown and describe above. A lock or other securing device may be configured with the actuation element to secure the wall panels from inadvertent or unintentional opening or operation. For example, as shown in FIGS. 5A-5B, a locking element 530 may be positioned or part of the actuation element 516. After unlocking the actuation element, operation of the actuation element will cause the wall panels attached to a connecting element to open.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure. Further, additional features and/or components can be incorporated into customizable elevator handrails as provided herein without departing from the scope of the present disclosure.

Advantageously, embodiments described herein provide elevator wall panel systems that are configured for relatively simple operation during maintenance operations. Embodiments provided herein allow a maintenance operation to be performed from inside the elevator car and eliminates any need to have a mechanic enter an elevator shaft or go on the elevator car roof.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator car wall panel system comprising:
an elevator car frame;
at least two wall panels pivotally connected to the frame;
a connecting element operably connecting the at least two wall panels; and
an actuation element operably connected to the connecting element, wherein the actuation element is operable to transition the at least two wall panels from a closed state to an open state,
wherein each wall panel is pivotally connected to the connecting element by a respective connector.

2. The elevator car wall panel system of claim 1, further comprising a locking element arranged to lock the at least two wall panels in the closed state.

3. The elevator car wall panel system of claim 1, wherein the connecting element is a rigid rod.

4. The elevator car wall panel system of claim 1, wherein each connector comprises a bracket and a connector extension.

5. The elevator car wall panel system of claim 4, wherein each connector extension is a part of the connecting element.

6. The elevator car wall panel system of claim 1, wherein the actuation element comprises at least one sliding pivot and at least one rotating pivot.

7. An elevator car comprising:
an elevator car frame;
an elevator car wall panel system having:
at least two wall panels pivotally connected to the frame;
a connecting element operably connecting the at least two wall panels; and
an actuation element operably connected to the connecting element, wherein the actuation element is operable to transition the at least two wall panels from a closed state to an open state,
wherein each wall panel is pivotally connected to the connecting element by a respective connector.

8. The elevator car of claim 7, wherein the elevator car includes a passenger space, wherein the at least two wall panels are aesthetic panels of the passenger space.

9. The elevator car of claim 7, wherein the connecting element is located at at least one of a ceiling and a floor of the elevator car.

10. The elevator car of claim 7, further comprising a locking element arranged to lock the at least two wall panels in the closed state.

11. An elevator system comprising:
an elevator car having an elevator car frame;
an elevator car wall panel system having:
at least two wall panels pivotally connected to the frame;
a connecting element operably connecting the at least two wall panels; and
an actuation element operably connected to the connecting element, wherein the actuation element is operable to transition the at least two wall panels from a closed state to an open state,
wherein the elevator car is positioned within an elevator shaft of the elevator system, and
wherein each wall panel is pivotally connected to the connecting element by a respective connector.

12. The elevator system of claim 11, wherein when the at least two wall panels are opened, at least a portion of the wall panels extends into the elevator shaft.

13. The elevator system of claim 11, further comprising at least one elevator component located within the elevator shaft, wherein when the at least two wall panels are opened, the at least one elevator component is accessible from the passenger space.

14. The elevator system of claim 11, wherein the elevator car includes a passenger space, wherein the at least two wall panels are aesthetic panels of the passenger space.

15. The elevator system of claim 11, further comprising a locking element arranged to lock the at least two wall panels in the closed state.

16. The elevator system of claim 11, wherein the connecting element is a rigid rod.

17. The elevator system of claim 11, wherein the actuation element comprises at least one sliding pivot and at least one rotating pivot.

* * * * *